US010213022B2

(12) United States Patent
Block et al.

(10) Patent No.: US 10,213,022 B2
(45) Date of Patent: Feb. 26, 2019

(54) RECREATIONAL ROTATING CHAIR

(71) Applicant: ORBIT BEACH CHAIR, LLC, Roosevelt, NJ (US)

(72) Inventors: Joseph A. Block, Roosevelt, NJ (US); Linda P. Block, Roosevelt, NJ (US); Amy B. Bright, Los Angeles, CA (US)

( * ) Notice: Subject to any disclaimer, the term of this patent is extended or adjusted under 35 U.S.C. 154(b) by 0 days.

(21) Appl. No.: 15/199,493

(22) Filed: Jun. 30, 2016

(65) Prior Publication Data

US 2017/0000261 A1 Jan. 5, 2017

Related U.S. Application Data

(60) Provisional application No. 62/186,987, filed on Jun. 30, 2015.

(51) Int. Cl.

| | |
|---|---|
| ***A47C 3/18*** | (2006.01) |
| ***A47C 1/026*** | (2006.01) |
| ***A47C 4/46*** | (2006.01) |
| ***A47C 7/68*** | (2006.01) |
| ***A47C 9/10*** | (2006.01) |

(52) U.S. Cl.

CPC ..... *A47C 3/18* (2013.01); *A47C 1/026* (2013.01); *A47C 1/0265* (2013.01); *A47C 4/46* (2013.01); *A47C 7/68* (2013.01); *A47C 9/10* (2013.01)

(58) Field of Classification Search

CPC ..... A47C 3/18; A47C 1/026; A47C 1/0265; A47C 4/46; A47C 7/68; A47C 9/10

See application file for complete search history.

(56) References Cited

U.S. PATENT DOCUMENTS

| | | | | |
|---|---|---|---|---|
| 5,567,014 | A * | 10/1996 | Fitch | A47C 3/18 297/344.21 |
| 5,580,129 | A * | 12/1996 | Findlay | A47C 1/0265 248/349.1 |
| 5,611,594 | A | 3/1997 | Findlay | |
| 6,890,033 | B1 * | 5/2005 | Casella | A47C 1/14 297/344.21 |
| 8,167,374 | B2 | 5/2012 | Findlay | |
| 8,272,684 | B2 * | 9/2012 | Obolewicz | A47C 3/18 297/16.2 |
| 8,979,184 | B2 * | 3/2015 | Stafford | A47C 3/18 297/16.2 |
| 2002/0117878 | A1 * | 8/2002 | Fox | A47C 3/18 297/16.2 |
| 2004/0140696 | A1 * | 7/2004 | Grace | A47C 9/105 297/16.2 |
| 2012/0286544 | A1 * | 11/2012 | Cohen | A47C 4/46 297/30 |
| 2014/0319883 | A1 * | 10/2014 | Shively | A47C 4/28 297/35 |

OTHER PUBLICATIONS

"Original Sunswivel Beach Chair Accessory," [online] retrieved on Oct. 14, 2016, retrieved from: http://patioeasy.com/product/original-sunswivel-beach-chair-accessory/, pp. 1-2.

* cited by examiner

*Primary Examiner* — Philip F Gabler
(74) *Attorney, Agent, or Firm* — Owen J. Bates

(57) ABSTRACT

Systems, devices, and methods are provided for a rotating chair, including an upper chair section, a lower chair section and a turntable mounted between the upper chair section and the lower chair section that allows the upper chair section to rotate with respect to the lower chair section.

19 Claims, 19 Drawing Sheets

RECREATIONAL ROTATING CHAIR

CROSS-REFERENCE TO RELATED APPLICATIONS

The present application claims priority to U.S. Provisional Application No. 62/186,987 filed Jun. 30, 2015, titled "RECREATIONAL ROTATING CHAIR" which is hereby incorporated by reference in its entirety.

FIELD

The subject matter described herein relates generally to a recreational chair with a pivoting upper section allowing a user to turn the upper section, including a seating section, while a lower section, such as a base section, remains stationary.

BACKGROUND

Recreational chairs often include some variation of legs, a seating surface and a back. Some include armrests as well. Most often these elements are fixed with respect to each other, while in some instances they are foldable. Recreational chairs, such as those designed for the beach, are often fixed in a single position that allows the user to sit and face a single direction but these do not allow the user to rotate the position of the chair without standing up and physically moving the entire chair. This is inconvenient for users who may wish to change the direction they are facing, as they must move the entire chair or sit in an uncomfortable position. This can lead to back pain, neck pain and other issues. Additionally, existing recreational chairs often provide a seating surface that is very low to the ground. This can lead to injuries for users when sitting down or standing up from the seating surfaces of these chairs, especially for users who may be inebriated, uncoordinated or physically impaired.

While there have been efforts made to remedy the problem of non-rotating chairs, existing chairs with pivoting or rotating elements are often heavy, sometimes upwards of fifteen or more pounds. As such, they are inconvenient for users to transport, since users may not have any hands free or may have only have a single hand free due to the fact that they may be dragging coolers or carrying umbrellas, bags, backpacks, sports equipment, children or other items or objects. Further, these chairs are inconvenient because they do not fold into compact configurations that take up minimal amounts of space when they are being transported in a vehicle or when they are being carried. Some foldable chairs can be wider than a foot in folded configurations. The components used to construct existing rotating chairs are often expensive as well.

One example of a prior art recreational chair is shown and described in U.S. Pat. No. 8,167,374. This recreational chair is deficient for the purposes of most recreational uses since it does not fold into a compact configuration, is heavy, has a seating surface that is low to the ground, has a base that will sink into non-rigid ground surfaces such as sand or mud and does not provide any storage or beverage holding elements which can increase convenience and enjoyment of users. Another example of a prior art recreational chair is shown and described in U.S. Pat. No. 5,611,594. However, this recreational chair is also deficient since it suffers from similar maladies.

Thus, needs exist for improved rotating chairs that provide convenience and increased user enjoyment because they are lightweight, inexpensive, foldable, easy to carry, have more elevated seating surfaces, will not sink into unstable ground supporting surfaces and have beverage holders and storage for personal items.

SUMMARY

Provided herein are embodiments of systems, methods and recreational chair apparatuses with rotatable seating areas. These embodiments can allow users to pivot in the chair while the base remains fixed in a stable location. This can be beneficial if a user does not wish to stand up to move the chair in order to comfortably change the position of the direction the chair is facing. As an example, a seated user may wish to rotate in the chair in order to watch action in a child's soccer game from one end of a field to another. As another example, a seated user at a beach may wish to change the position of the chair in order better view the ocean, converse face to face with a friend during a conversation or change positions for better sun exposure during tanning. Some contemplated locations and uses for the embodiments disclosed herein include sitting at a beach, pool, lake, river, sporting event, concert, backyard barbecue, camping, stargazing, fishing, park or anywhere else a lightweight outdoor rotating chair may be desired and useful. The configurations described herein are detailed by way of various embodiments which are only examples and not meant to be exhaustive.

Other systems, devices, apparatuses, methods, features and advantages of the subject matter described herein will be or will become apparent to one with skill in the art upon examination of the following figures and detailed description. It is intended that all such additional systems, devices, apparatuses, methods, features and advantages be included within this description, be within the scope of the subject matter described herein, and be protected by the accompanying claims. In no way should the features of the example embodiments be construed as limiting the appended claims, absent express recitation of those features in the claims.

BRIEF DESCRIPTION OF THE FIGURES

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

DETAILED DESCRIPTION

Before the present subject matter is described in detail, it is to be understood that this disclosure is not limited to the particular embodiments described, as such may, of course, vary. It is also to be understood that the terminology used herein is for the purpose of describing particular embodiments only, and is not intended to be limiting, since the scope of the present disclosure will be limited only by the appended claims.

Provided herein are example embodiments of a chair with an upper section that can rotate with respect to a lower section that can remain in a fixed position. The device will be referred to interchangeably as a "chair" and "rotating chair" herein. It should be understood that similar reference numbers used with respect to the various embodiments herein correspond to similar structures and elements.

FIGS. 1-5 show an example embodiment of a portable, folding, rotating chair 100 from various different perspective views.

Figure 1:
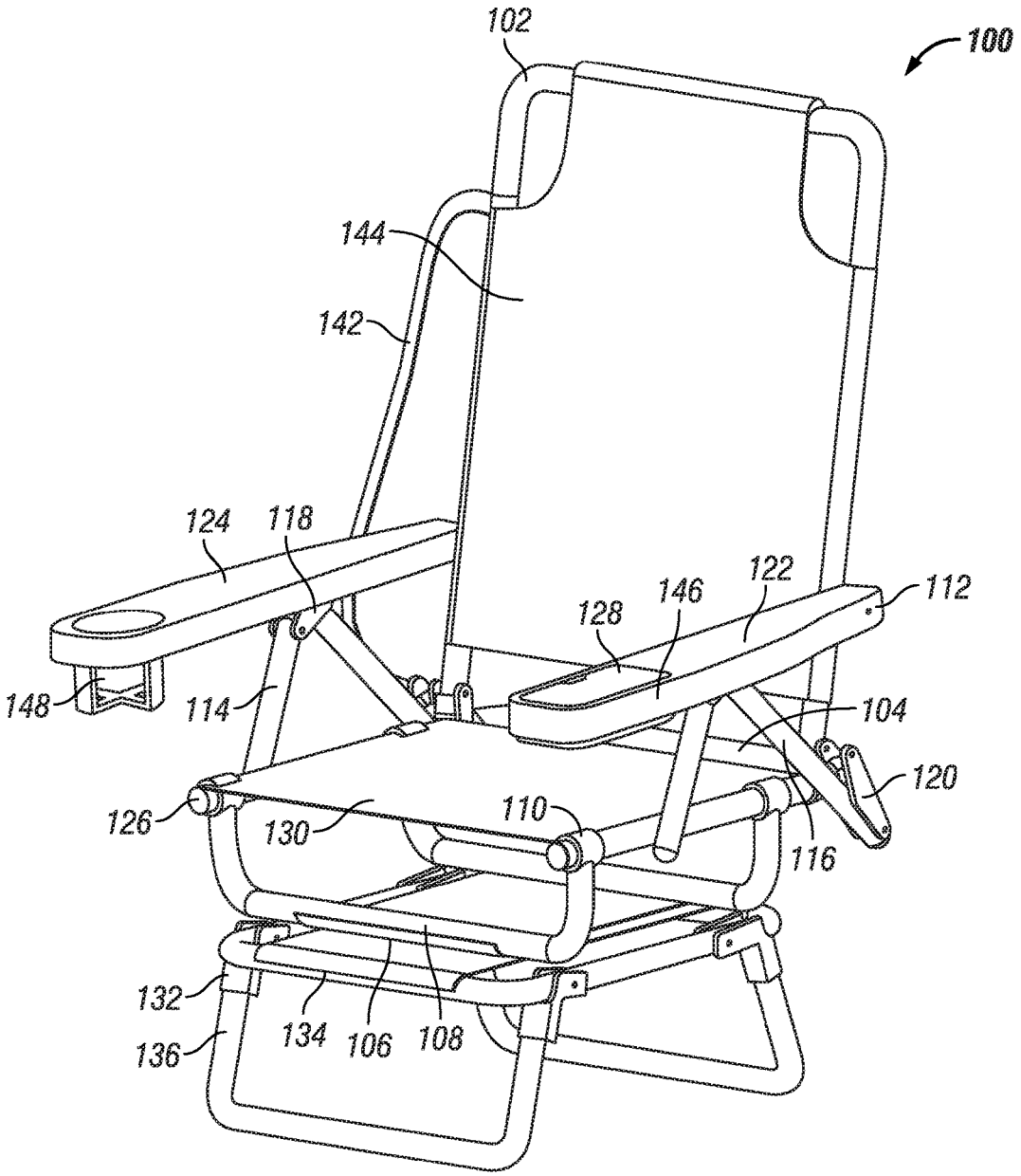
FIG. 1 depicts an example embodiment of a rotatable chair from a front right perspective view.

FIG. 1 depicts an example embodiment of a portable, folding, rotating chair 100 from a front right perspective view. As shown in the example embodiment, rotating chair 100 can include legs 136 that provide support for a user and serve to hold the user at an elevation above a ground surface, such as cement, asphalt, grass, mud, dirt, sand and others. Legs 136 can be solid or hollow tubular structures and can have various different cross sections including triangular, square, rectangular, circular, semi-circular, oval or others and can be regular or irregularly shaped. Corners of non-rounded cross sectional shapes can be rounded in some embodiments. Legs 136 can attach or otherwise be coupled to a bottom mounting plate 134 by one or more leg hinges 132. Leg hinges 132 can allow legs 136 to be folded under the chair for easy transportation and setup at a desired location while minimizing an overall size of chair 100 when in a folded configuration, such as during transportation in a vehicle, compartment, bag or when carrying by hand. Leg hinges 132 can also be rigid and have a surface that inhibits legs 136 from expanding outward in opposing directions from each other, therefore causing or allowing chair 100 to fall or otherwise collapse to the ground. Leg hinges 132 can be high density polyethylene, metal or other materials in various embodiments. When in folded configurations, multiple chairs 100 can be stacked for easy transportation in a vehicle, compartment, bag or when carrying by hand. In some embodiments, leg hinges 132 can include narrow portions or other interior structures allowing legs 136 to be locked into one or more positions or configurations. For example, in an open configuration for seating and in a closed configuration for folding and transportation.

A single chair 100 can weigh less than about ten or eleven pounds in order for easy carrying, even by smaller individuals.

Figure 8A:
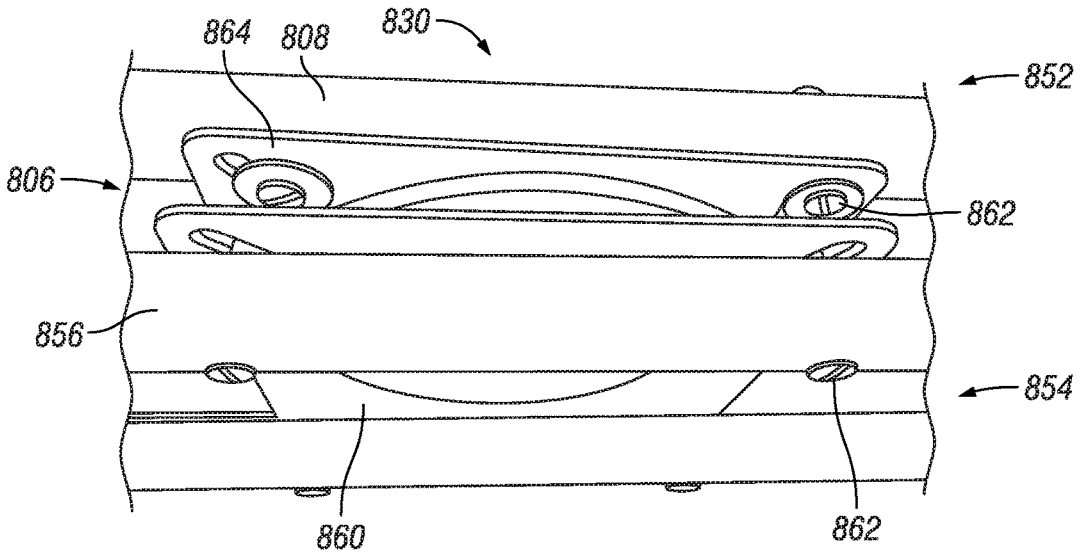
FIGS. 8A-8B depict an example embodiment of a turntable from a side and perspective view, respectively.
Figure 8B:
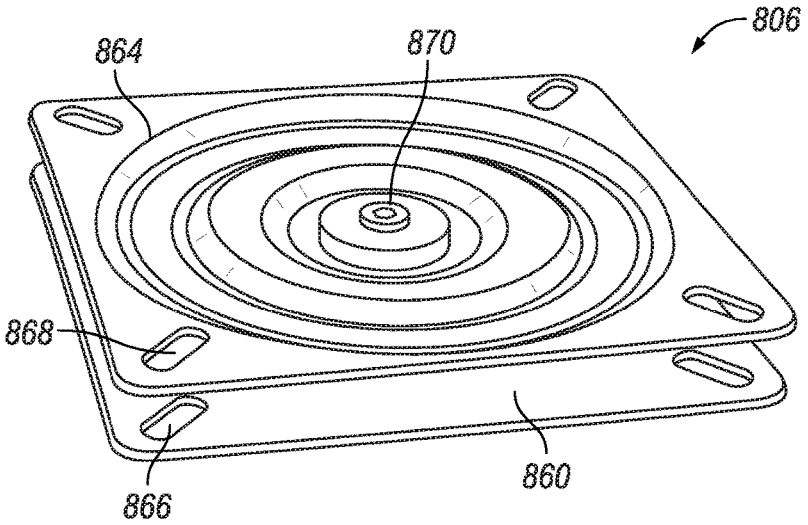
Figure 9A:
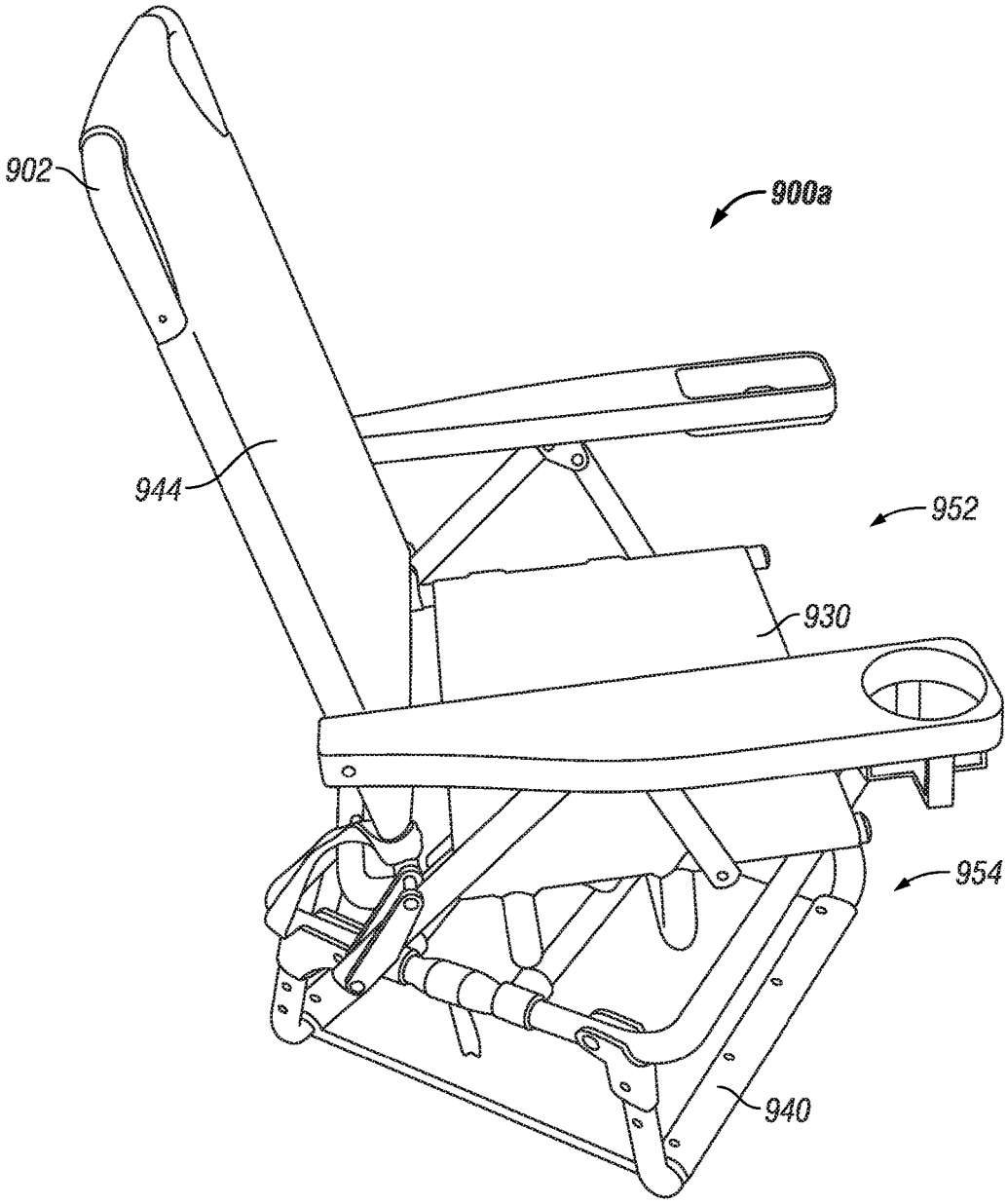
FIGS. 9A-9D depict an example embodiment of a chair in four fixed positions from upright seating to fully reclined, respectively.
Figure 9B:
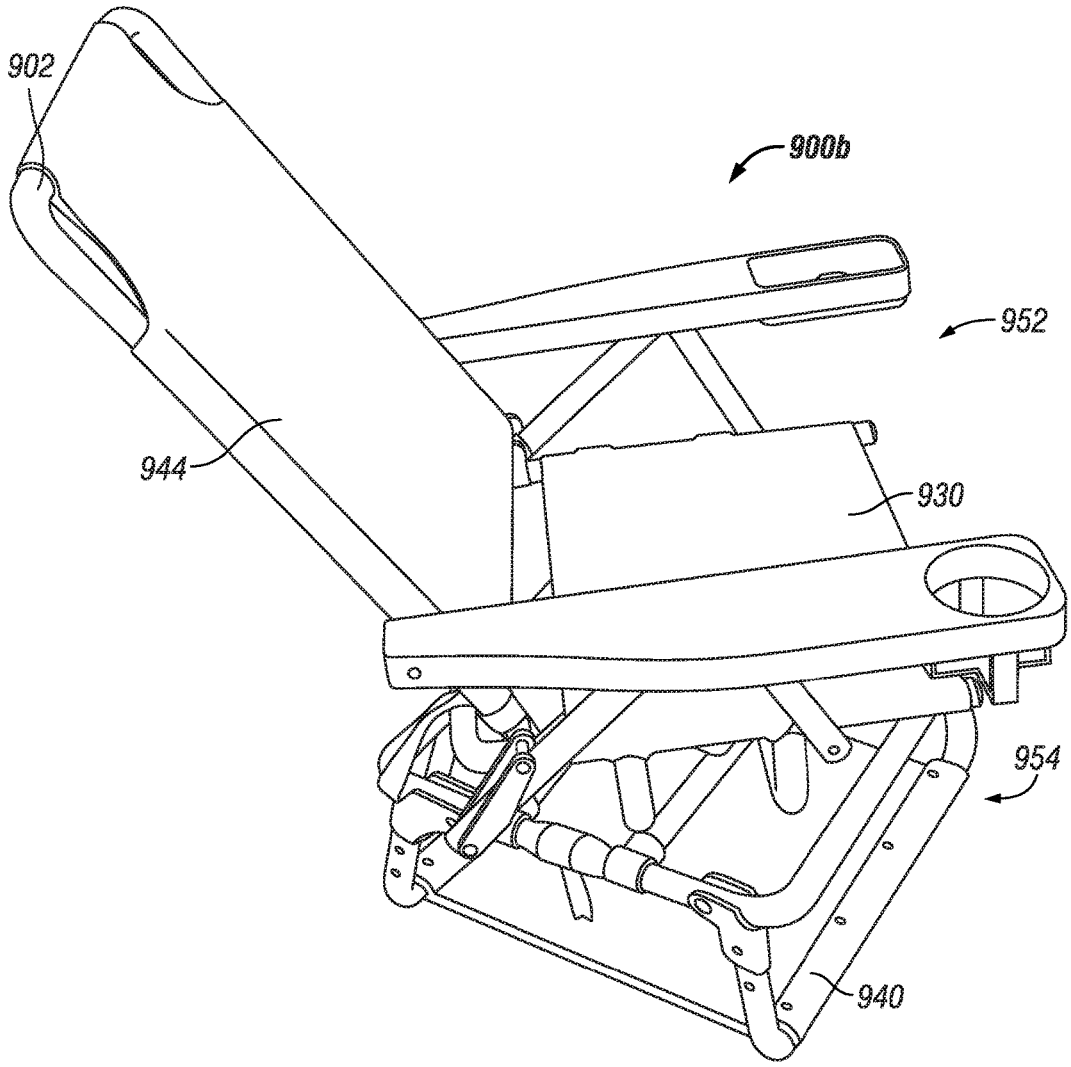
Figure 9C:
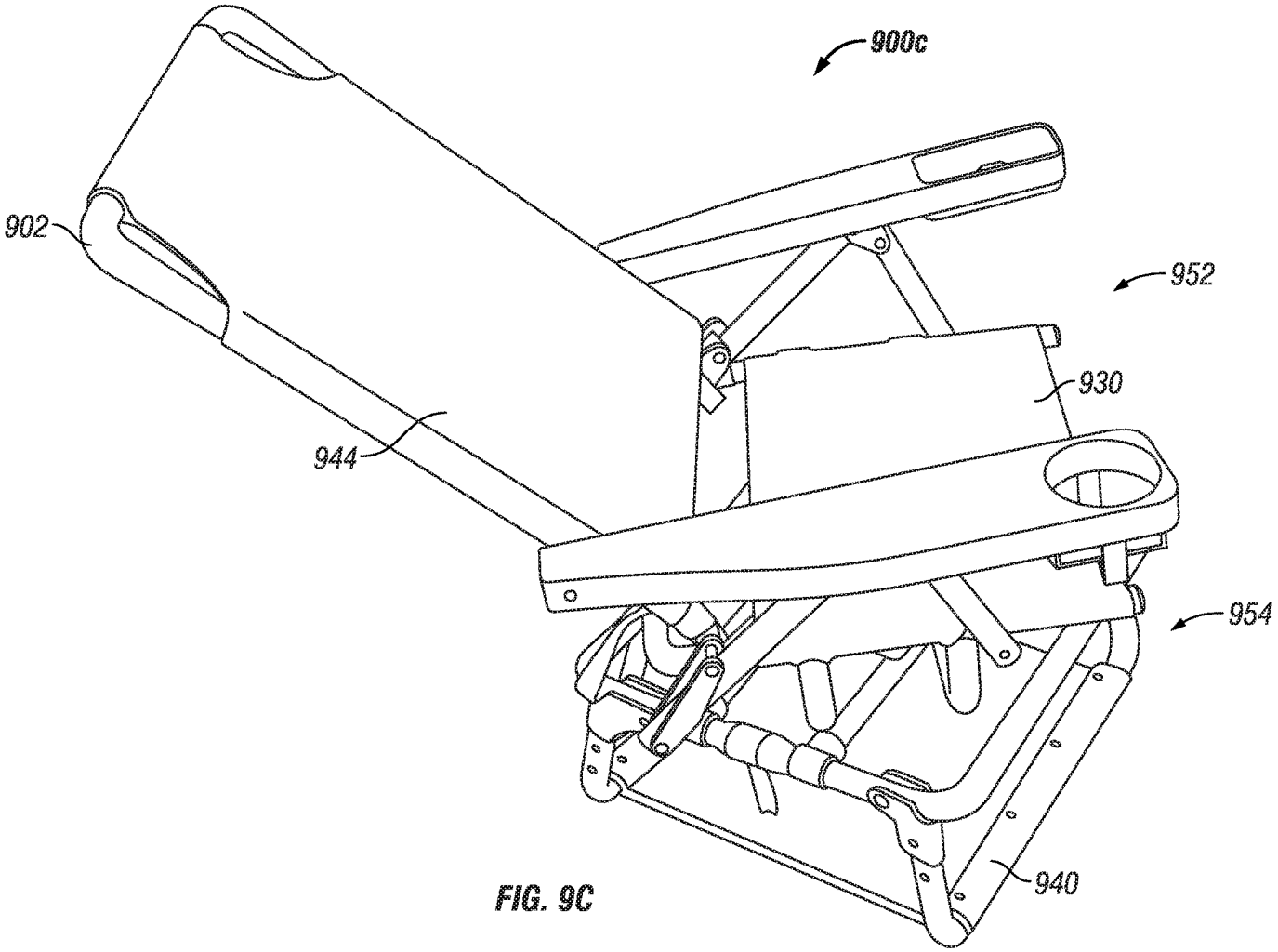
Figure 9D:
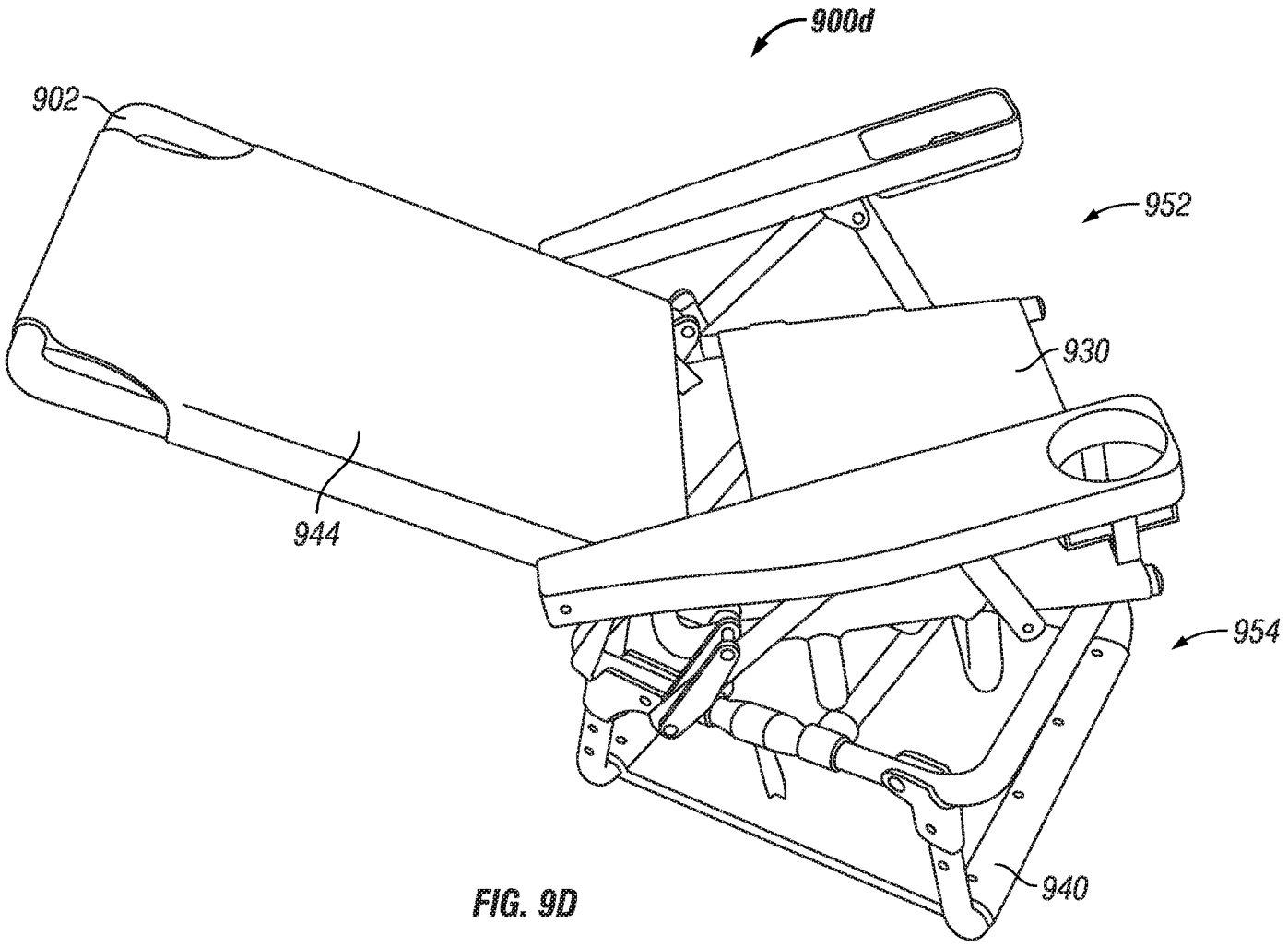

Bottom mounting plate 134 can be anodized aluminum in some embodiments and can provide a mounting location for a stationary portion of a turntable 106, discussed further herein with respect to FIGS. 8A-8B. Turntable 106 can be attached or otherwise coupled to one or more under-seat bars 108. Under-seat bars 108 can be attached or otherwise coupled to one or more seat bars 104 using one or more brackets 110. Seat bars 104 can provide anchor locations for a seat base 130, where a user can be supported while sitting. Seat bars 104 can be located at a rear of seat base 130 of chair 100, at the sides and at the front in various embodiments. Seat base 130 can be one or more of a variety of fabrics, such as an UltraViolet (UV) Vinyl coated polyester mesh, canvas, hemp, cotton, a rigid Cordura® Nylon fabric (by Invista) or other durable fabric. Seat bars 104 can be pivotably attached or otherwise coupled to at least one back bar 102. As such, the orientation of back bar 102 with respect to seat bars 104 can be fixedly adjusted from at or around parallel and adjacent with respect to each other in a compact or otherwise closed configuration, to at or around perpendicular with respect to each seat bars 104 and past perpendicular to various obtuse angles with respect to seat bars 104 for opened, seating or lounging configurations. Back bar 102 can provide at least one attachment or coupling location for a seat back support 144, which can be the same fabric as seat base 130 in some embodiments and can support a user's back when seated.

First Side bars 114 can be coupled with or otherwise attached to an arm bracket 118, in turn coupled to one or more of a First armrest 122 or Second armrest 124 and seat bars 104 by a hinge 120. Similarly, second side bars 116 can attach by an arm bracket 118 to First armrest 122 or Second armrest 124 and to seat bars 104 by a hinge 120. Caps 126 can be removably or permanently coupled with or otherwise attached to any hollow open tubes or bars in order to prevent injury and to prevent foreign objects or water from entering the hollow interior of the bars that may cause corrosion from becoming lodged inside the bars. They can be bullet shaped or flat in various configurations.

One or more straps 142 can be attached to or otherwise coupled with chair 100 to provide simple and easy carrying and transportation of chair 100 for users. Embodiments including one strap 142 can be carried across the body of a user, by hand or over a single shoulder while embodiments including multiple straps 142 can be carried over both shoulders, similar to a backpack and in some embodiments, around a waist as well. Straps 142 can be made from various materials having differing levels of rigidity and flexibility in various embodiments, such as fabric, and may be the same as back support 144, seat base 130, or both. Some example fabrics include: a nylon webbing, an UltraViolet (UV) Vinyl coated polyester mesh, canvas, hemp, cotton, a rigid Cordura® Nylon fabric (by Invista) or other durable fabric. Alternatively, straps 142 can be different materials that may be semi-rigid such as various plastics and others.

Figure 2A:
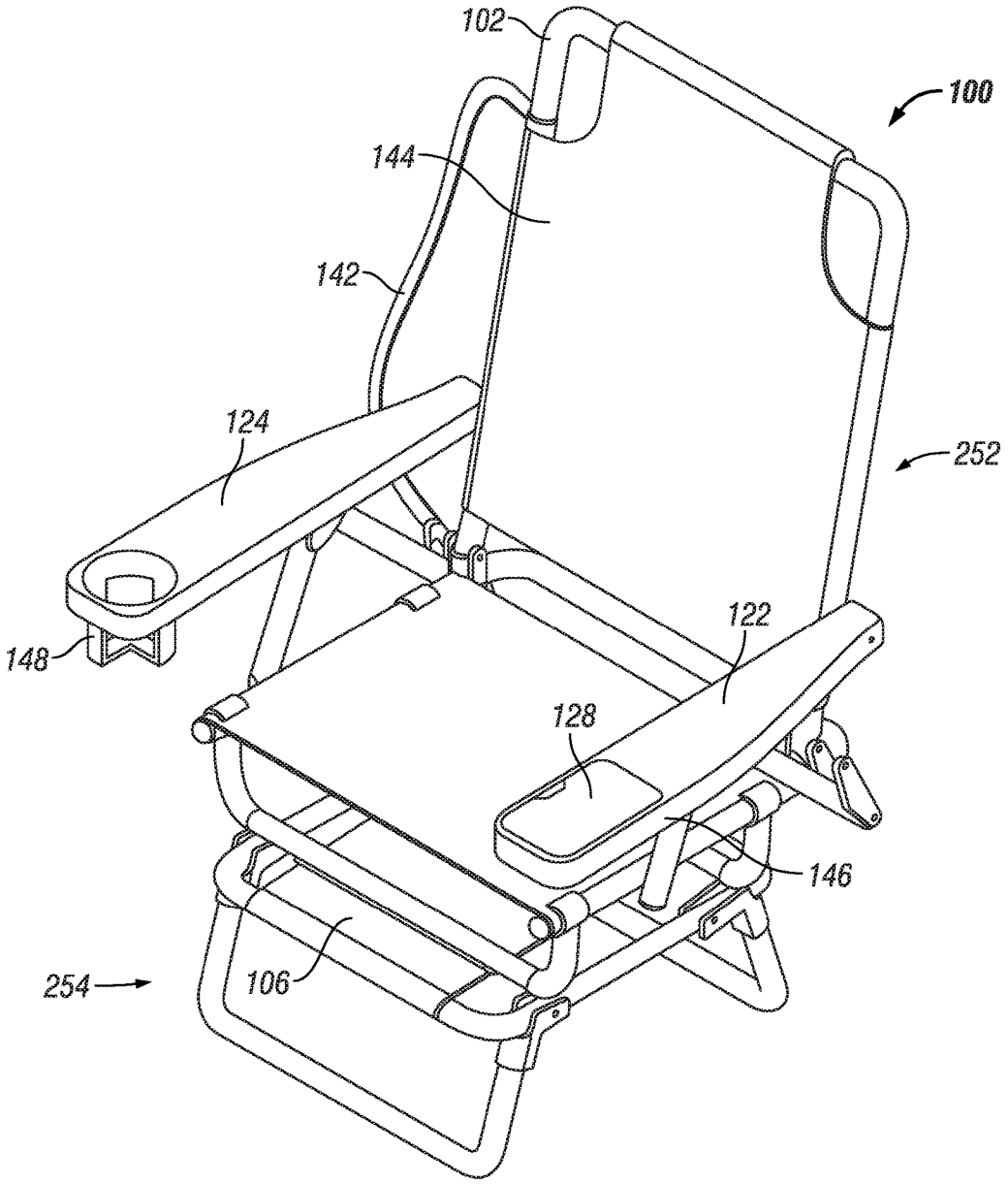
FIGS. 2A-2B depict an example embodiment of a rotatable chair from elevated front right perspective views.
Figure 2B:
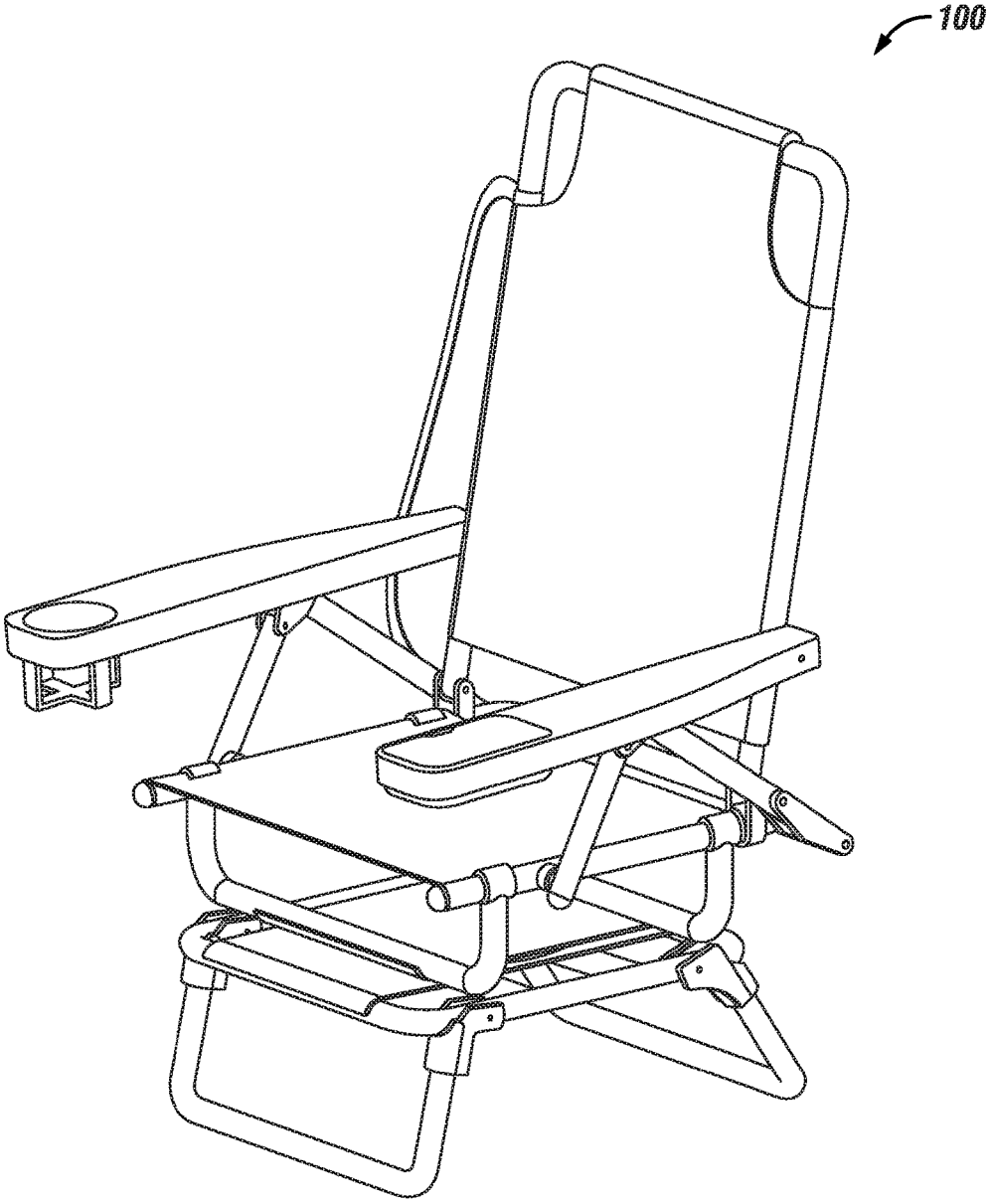

FIGS. 2A-2B depict an example embodiment of a rotatable chair 100 from elevated front right perspective views. As shown in the example embodiment, an upper chair portion 252 can include a seating area for a user while a lower chair portion 254 can provide a supporting base. Upper chair portion 252 and lower chair portion 254 can be coupled by at least a turntable (not shown) as further described with respect to FIGS. 8A-8B.

In the example embodiment, a First armrest 122 can be a left arm support for a seated user and can include at least one storage compartment 146 with a hinged lid 128. Storage compartment 146 can be plastic or other material and can be large enough to house a standard or large smartphone, keys, digital music player, wallet, credit cards, coins, paper money, seashells or other personal effects or items. Lid 128 can help maintain protection for the device and keep it out of direct sunlight. In some embodiments, lid 128 can provide a waterproof seal for the interior of compartment 146 to protect the contents thereof. Lid 128 can be closed such that it will not open unless a user wishes to access the compartment within using a small latch, magnet or other mechanism, while in some embodiments it can also be locked with a small key and locking mechanism. In some embodiments, one or more trays or other similar structures can include one or more individual sub-compartments and may be removable from storage compartment 146 for cleaning, carrying or other use. Hinged lid 128 can be coupled with one or both of storage compartment 146 or First arm rest 122 by a living hinge or other appropriate hinged mechanisms and components, as are known in the art or later developed.

Also shown in the example embodiment, Second armrest 124 can be a right arm support for a seated user and can include a beverage holder 148 for holding beverage containers such as cups, thermoses, glasses, bottles or others. Beverage holder 148 can be molded from plastic and can have one or more openings in its side and lower surfaces to allow for easy drainage of sand or other solids and liquids from perspiration on the sides of cooled or heated beverage containers. These openings can also provide a reduced and simplified cleaning process for users of chair 100.

In various embodiments, First armrest 122 and Second armrest 124 can be lightweight, UltraViolet (UV) protected plastic that does not rot, splinter or crack and is durable enough to withstand harsh weather if stored outdoors. This can provide a significant advantage over similar recreational chairs that have unfinished or untreated wooden armrests and may be prone to weathering effects. This material can also provide cost advantages since it can be cheaply produced as compared to comparable products in the industry. As shown and further described with respect to FIGS. 10 and 11A-11B, First and Second armrests 122, 124 can be hollow or otherwise open, such that their undersides are exposed and can have rib features to enhance structural support. This can provide the advantages of being light and easy to clean as well as being cheaper to manufacture. In various other embodiments, different materials and configurations of First and Second armrests 122, 124 can be treated or finished wood, aluminum or other metals, other plastics and composite materials, as appropriate.

Figure 3:
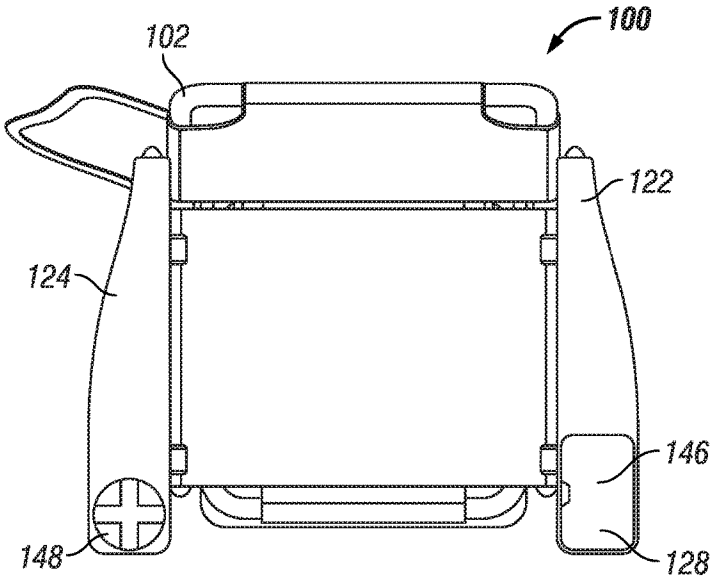
FIG. 3 depicts an example embodiment of a rotatable chair from a top-down view.

FIG. 3 depicts an example embodiment of a rotatable chair 100 from a top-down view. As shown in the example embodiment, beverage holder 148 can have a radius of about 1.75 inches or, in different radii in other embodiments, to accommodate large fountain containers or other beverage containers. First armrest 122 and Second armrest 124 can be about 3.75 inches wide at their widest areas and storage compartment 146 and its hinged lid 128 can be about 5.75 inches long. Full width of rotatable chair 100 can be about 27.00 inches from the outer edge of First armrest 122 to the outer edge of Second armrest 124. As shown in the example embodiment, beverage holder 148 can have a cross configuration with four similarly shaped openings when viewed from this angle. It should be understood that in other embodiments one or more of the dimensions described herein may vary to accommodate different body sizes for users of chair 100, or different objectives, such as providing a larger compartment 146 to hold larger or higher quantities of items. As such, First and Second armrests 122, 124 need not be identically wide or long in various embodiments.

Figure 4A:
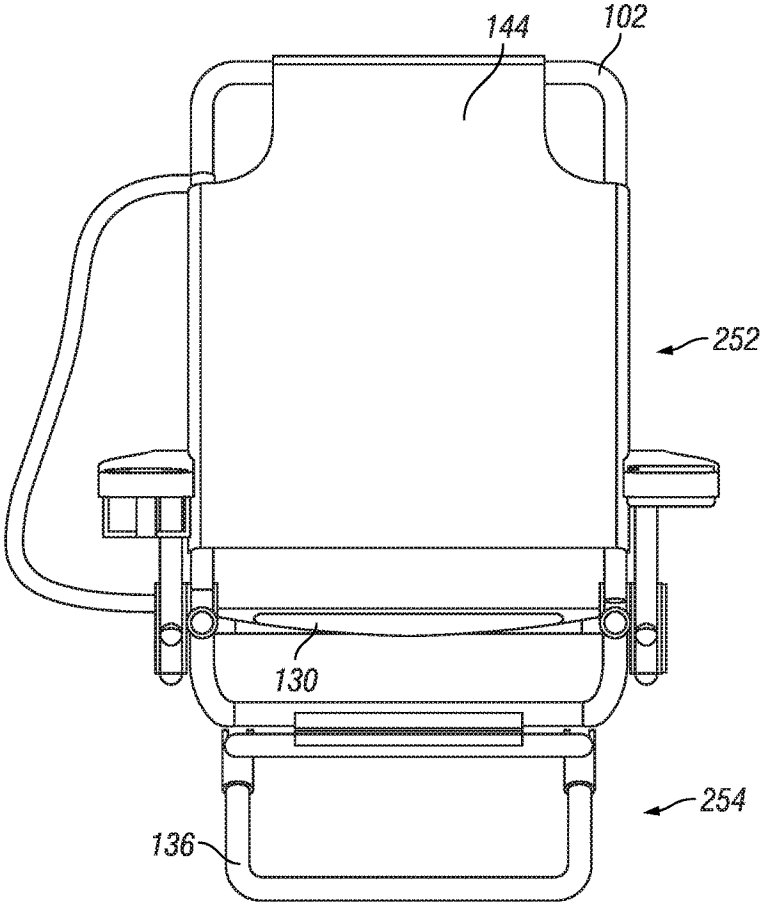
FIGS. 4A-4B depict an example embodiment of a rotatable chair from a front view.
Figure 4B:
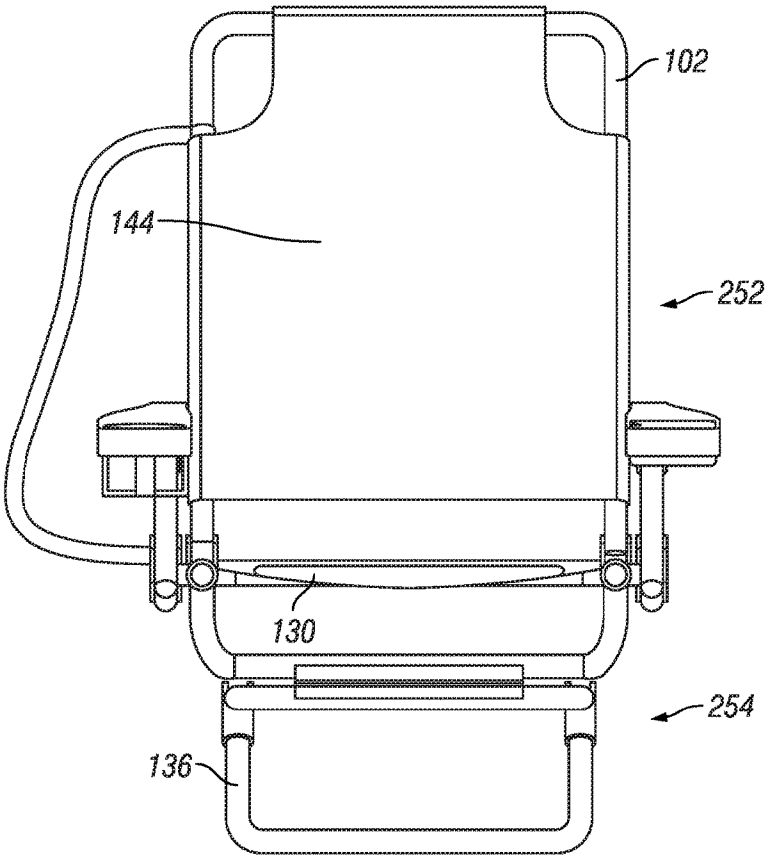

In some embodiments, First armrest 122 and Second armrest 124 can be about 4.00 inches wide at their widest areas. Various bars, such as back bar 102, can be about 0.94 inches in circumference in some embodiments FIGS. 4A-4B depict an example embodiment of a rotatable chair 100 from a front view. As shown in the example embodiment, seat back support 144 can have dimensions of about nineteen inches wide by about 21.67 inches tall. As shown in the example embodiment, seat back support 144 may have one or more cutouts or other areas lacking fabric at one or both of its top corners when coupled with back bar 102 in order to provide another easy carrying location for users to pick up chair 100 and move it or transport it. Additionally, seat back support 144 can be coupled to back bar 102 at a plurality of locations. In the example embodiment, this is shown as a top, left and right location. A bottom edge of seat back portion 144 may be free of coupling and create a space above seat base 130, thereby allowing air to flow through and sand or other debris to be easily brushed off of seat base 130. Also shown is a width of legs 136 as being about 15.94 inches from an outer left edge to an outer right edge.

Figure 5A:
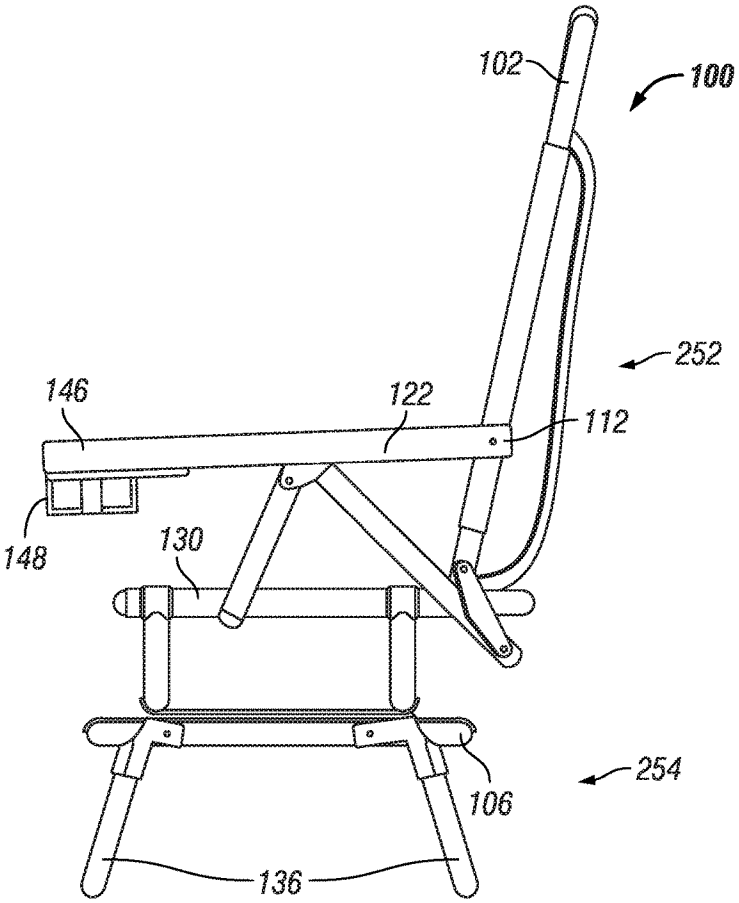
FIGS. 5A-5B depict an example embodiment of a rotatable chair from a side view.
Figure 5B:
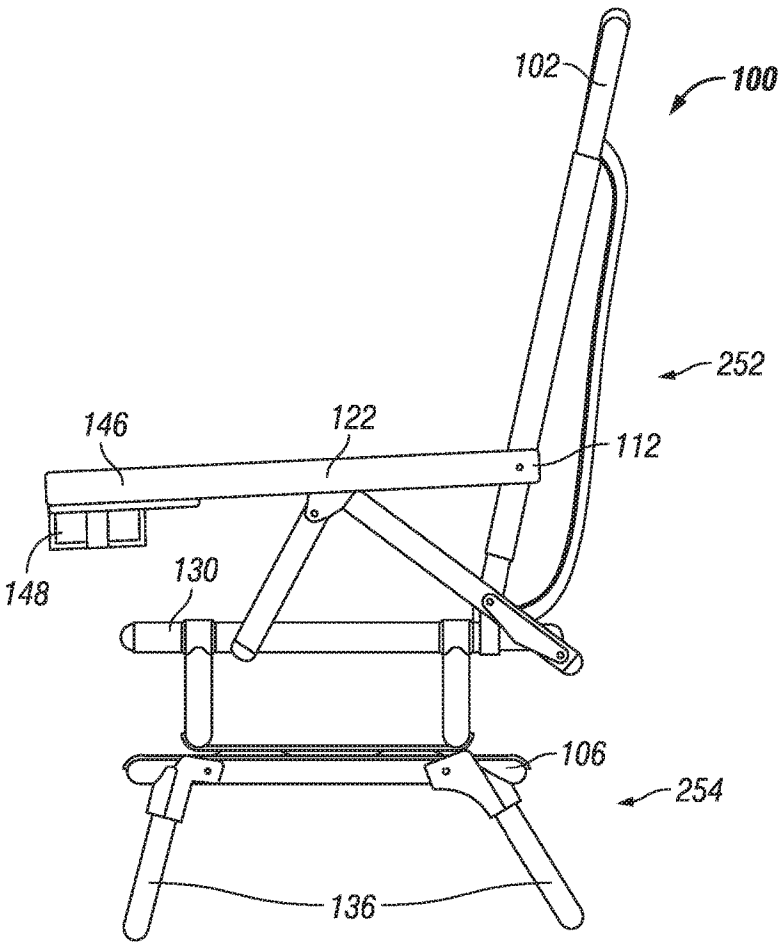

FIGS. 5A-5B depict an example embodiment of a rotatable chair 100 from a side view. As shown in the example embodiment, upper surfaces of Second armrest (obscured) and First armrest 122 can be roughly or about parallel while beverage holder 148 may hang below lower edge of the Second armrest. First armrest 122 and Second armrest can be about 19.5 inches from a front surface to a back surface and can be coupled with back bar 102 at armrest hinges 112, near the back edges of each of First armrest 122 and Second armrest on their respective interior surfaces. In the example embodiment, First armrest 122 and Second armrest are about the same thickness, about one inch, from their upper surfaces to their lower edges. In the example embodiment, storage compartment 146 is shown as about the same thickness as First armrest 122 but it can have differing dimensions in other embodiments, such that it provides a larger interior space to hold larger items.

Users of rotatable chair 100 can be seated about 12.58 inches above a ground surface on an upper surface of seat base 130, when measured to a ground contacting bottom surface of legs 136 in a seating configuration. Lower portion 254 of rotatable chair 100 can be about 7.20 inches from a ground contacting bottom surface of legs 136 to an upper surface of mounting plate 134 in a seating configuration. A combination height of rotatable chair 100, including lower portion 254 and upper portion 252 can be about 33.77 inches from a ground contacting bottom surface of legs 136 to an upper surface of the top of back bar 102 in a seating configuration. Legs 136 can spread to varying distances apart in various embodiments.

Figure 6:
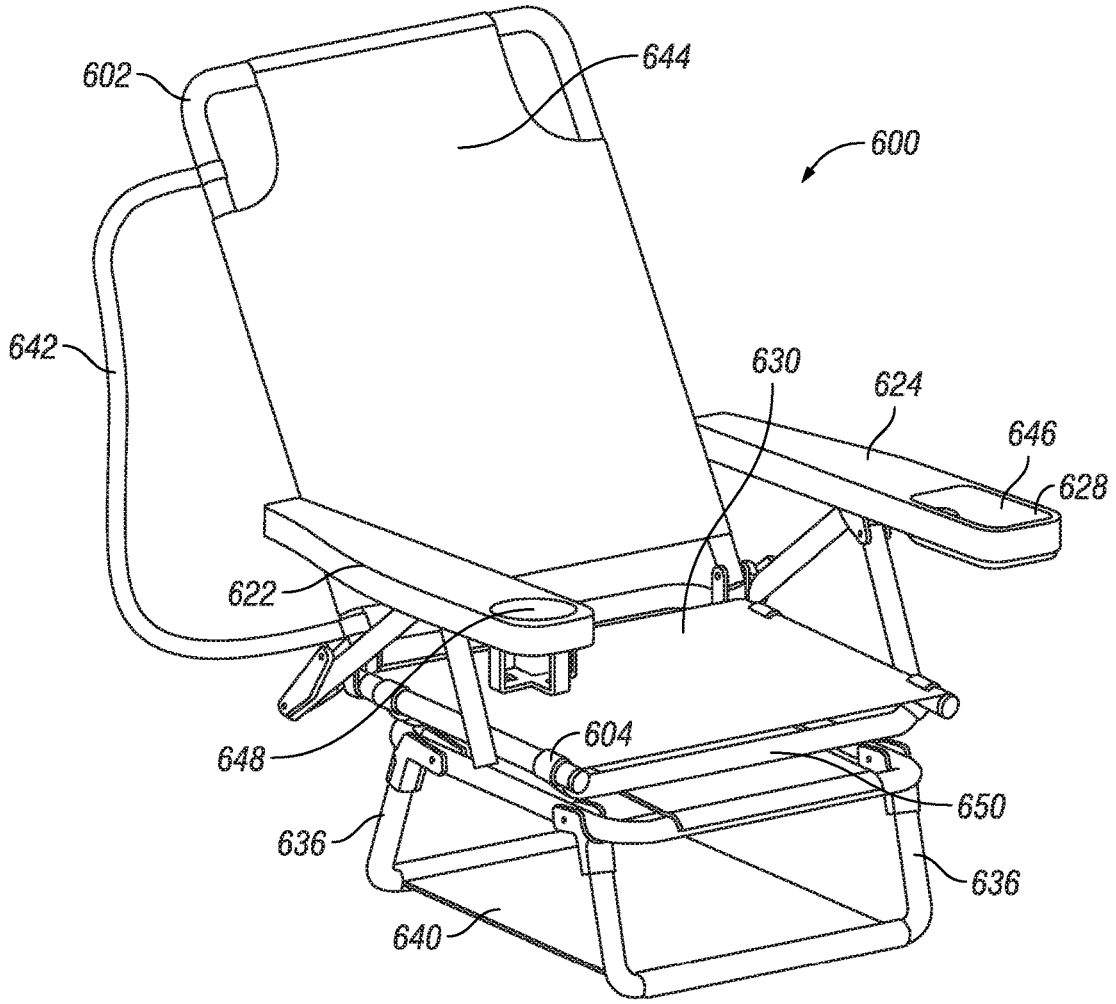
FIG. 6 depicts an example embodiment of a rotatable chair from a front left perspective view.

FIG. 6 depicts an example embodiment of a rotatable chair 600 from a front left perspective view. As shown in the example embodiment, a support base 640 can be a fabric or other pliable material that can be the same as or different from that used for seat back support 644 and seat base 630. Support base 640 can be extended between legs 636, such that it is substantially parallel with seat base 630 in a seating configuration. Support base 640 can prevent chair 600 from sinking into gravel, sand, mud or other non-sturdy ground since the lower or bottom surface of support base provides greater surface area contact with the ground, as compared with legs 636 alone. Additionally, support base 640 can prevent debris from entering and interfering with turntable (obscured) by maintaining chair 600 in a raised position with respect to the ground. Legs 136 can spread to a distance of about eighteen inches apart, such that support base 640 is fully stretched to a substantially flat configuration of about 15.25 inches wide and twenty-two inches long before coupling with chair legs 636 in various embodiments. In some embodiments, support base 640 can reduce costs compared to prior art or other solutions when it is made of durable fabric, rubberized material or plastic, since these can be cheaper than aluminum or other metal materials that may be used in a similar configuration in different chairs to provide similar benefits. Rotatable chair 600 also includes first arm rest 622 and second armrest 624. First arm rest 622 also includes beverage holder 648. Second armrest 624 also includes at least one storage compartment 646 which can be covered by at least one hinged lid 628.

Support base 640 can be coupled to legs 636 in various embodiments using permanent or removable adhesives, or other mechanisms such as hook and loop fasteners. Likewise, back support 644 can be coupled with back bar 602 and seat base 630 can be coupled to seat bars 604 and front seat bar 650 in various embodiments using permanent or removable adhesives, or other mechanisms such as hook and loop fasteners. In some embodiments, one or more of support base 640, back support 644, strap 642 and seat base 630 can be removably coupled or otherwise detached to their respective locations such that they can be easily removed and replaced or cleaned before being recoupled, attached or reattached when desired or required. As such, one or more of support base 640, back support 644, strap 642 and seat base 630 can couple include mating portions with different surfaces of chair 600, including themselves.

As shown in the example embodiment, a front seat bar 650 can be coupled to one or more seat bars 604 in order to provide additional benefits such as a more compact setup when in a folded configuration, additional support for users and other benefits. In some embodiments, one or more seat bars 604 and front seat bar 650 can be monolithic, such that they are part of a single unified structure. Front seat bar 650 can be the same material as other bars in some embodiments while in others it can be a softer material in order to increase user comfort. Front seat bar 650 can also be ergonomically shaped in some embodiments such that it comfortably curves and conforms to a typical leg shape and size of a user.

Figure 7:
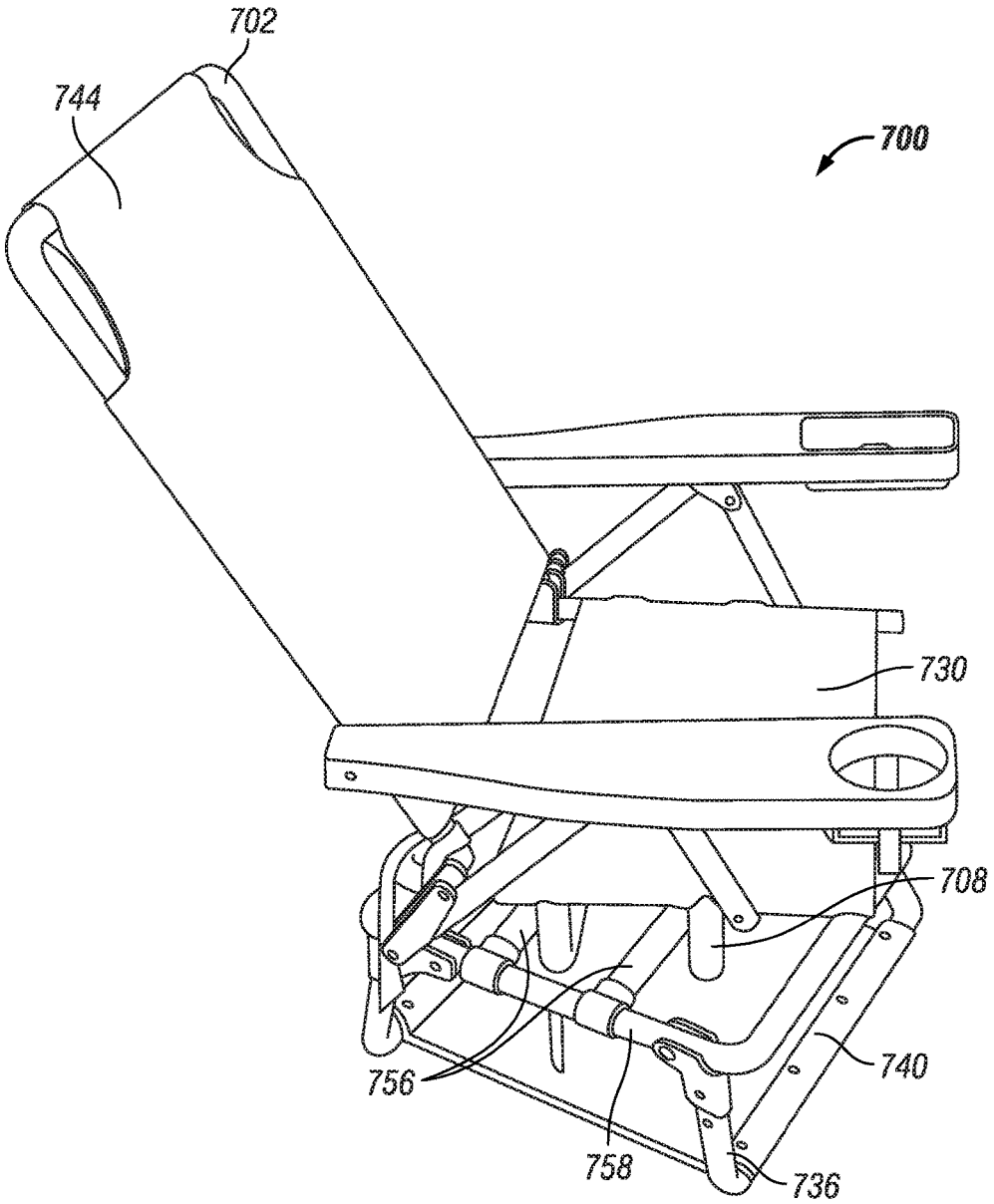
FIG. 7 depicts an example embodiment of a rotatable chair from a side perspective view.

FIG. 7 depicts an example embodiment of a rotatable chair 700 from a side perspective view. As shown in the example embodiment, a rotatable chair 700 can include one or more lower crossbars 756 which a turntable (obscured) can be mounted to in lieu of a mounting plate and which are in turn coupled with a lower mounting structure 758 using brackets. Lower mounting structure 758 can be coupled with legs 736 using additional brackets. Seat back support 744 is attached to back bar 702. Seat base 730 is supported by under-seat bars 708. Support base 740 is attached between legs 736.

FIGS. 8A-8B depict an example embodiment of a turntable 806 from a side and perspective view. Turntable 806 can allow for 360-degree rotation of an upper chair portion 852, including a seat base 830 where a user sits, with respect to a lower chair portion 854 including legs 836 such that a user can swivel the seat.

To elaborate, a lower turntable plate 860 can be coupled to one or more lower crossbars 856 using a coupling element 862 at a coupling location 866, such as a screw and nut mechanism or others. Similarly, an upper turntable plate 864 can be coupled to Under-seat bars 808 using a coupling element 862 at an upper coupling location 868. When desired, a user can rotate turntable 806 about a central axis bolt 870, such that turntable 806 provides a smooth, non-obstructed 360-degree rotation of upper portion 852 with respect to lower portion 854. Turntable 806 can include one or more ball bearings protected by an outer silicone seal to provide the rotation mechanism, as well as zinc coating and to protect from corrosion.

In some embodiments turntable 806 can be coupled to mounting plates, while in some embodiments turntable 806 may have differing structures, such as mounting bars or others.

Turntable 806 can be an off-the-shelf standalone component in some embodiments that is lightweight and inexpensive. This can allow rotatable chair users to repair, maintain or replace turntable 806 if it wears down, breaks or otherwise is not performing optimally.

FIGS. 9A-9D depict an example embodiment of a chair in four different reclining positions 900*a*-900*d* from upright to fully reclined, respectively. As shown in the example embodiments, components of upper portion 952, including back support 944 and back bar 902 of chairs 900*a*-900*d*, can be successively reclined to predefined orientations, and in some embodiments locked in preset or variable positions at different angles using one or more securing mechanisms with respect to lower portion 954, where support base 940 remains in a specific orientation and seat base 930 is allowed to rotate while remaining in a single plane. In such reclining embodiments, securing mechanisms can include hooks, ratcheting mechanisms or others, as appropriate.

Figure 10:
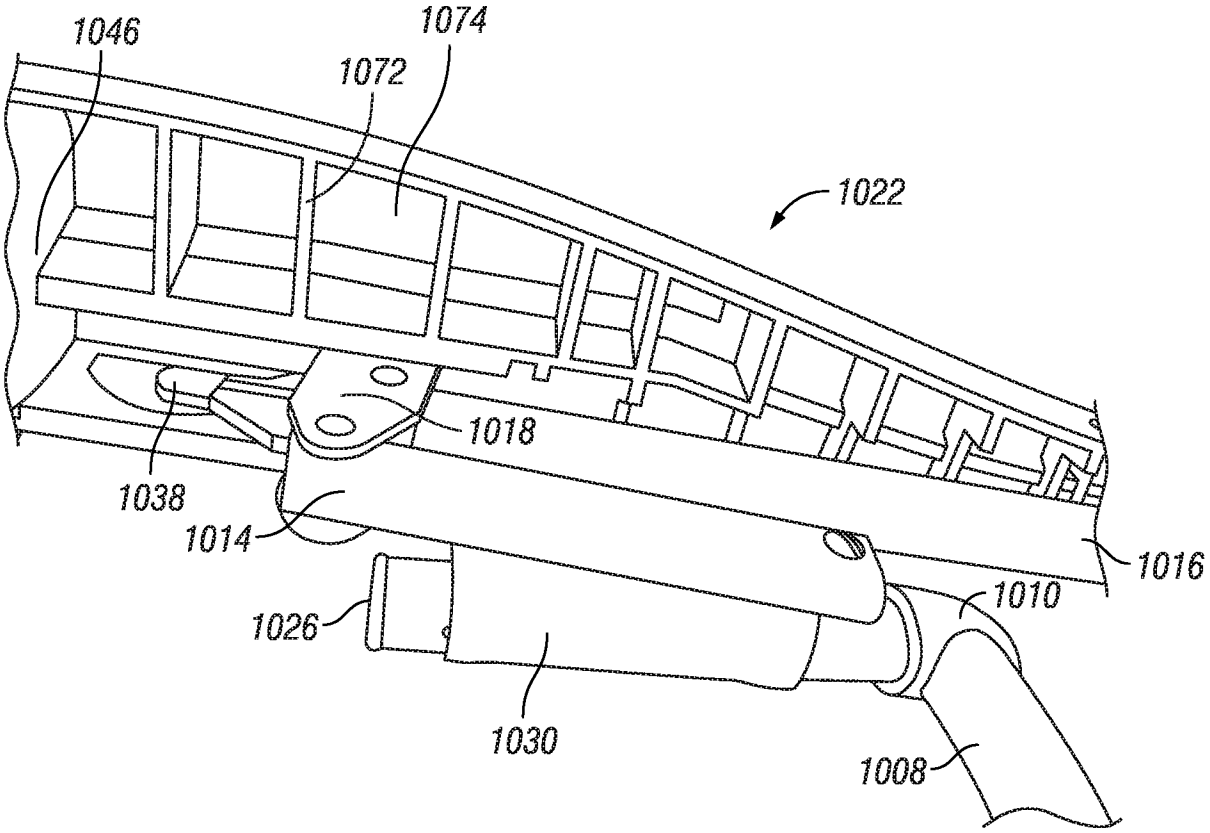
FIG. 10 depicts an example embodiment of a first armrest underside.

FIG. 10 depicts an example embodiment of a First armrest 1022 underside. As shown in the example embodiment, various ribs 1072 can provide structural support for a hollow underside of First armrest 1022 by extending from its undersurface 1074. As shown, First armrest 1022 is in a collapsed configuration, with first side bar 1014, second side bar 1016, and under-seat bar 1008 in a nearly parallel configuration. Also shown are seat base 1030 and cap 1026 coupled to under-seat bars 1008 by way of bracket 1010 and a portion of storage compartment 1046.

As shown in the example embodiment, a channel or other track 1038 shaped in First Armrest 1022 can include one or more depressions or other shaped features in order to allow arm bracket 1018 to be locked in particular fixed locations. When users of rotatable chairs with to recline the back support of the chair, they can lift chair arms out of the depressions, allowing arm bracket 1018 to be moved along track 1038 and settled, placed or otherwise locked in a different depression for a different back support reclining configuration, such as those shown in FIGS. 9A-9D. Similar features can be provided for Second armrests.

Figure 11B:
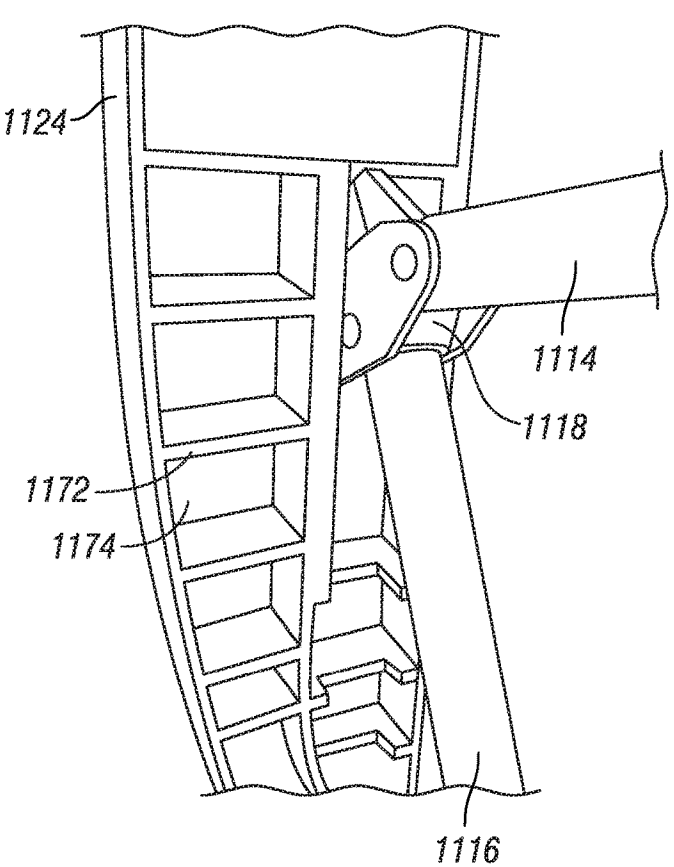
FIGS. 11A-11B depict an example embodiment of a second armrest underside.
Figure 11A:
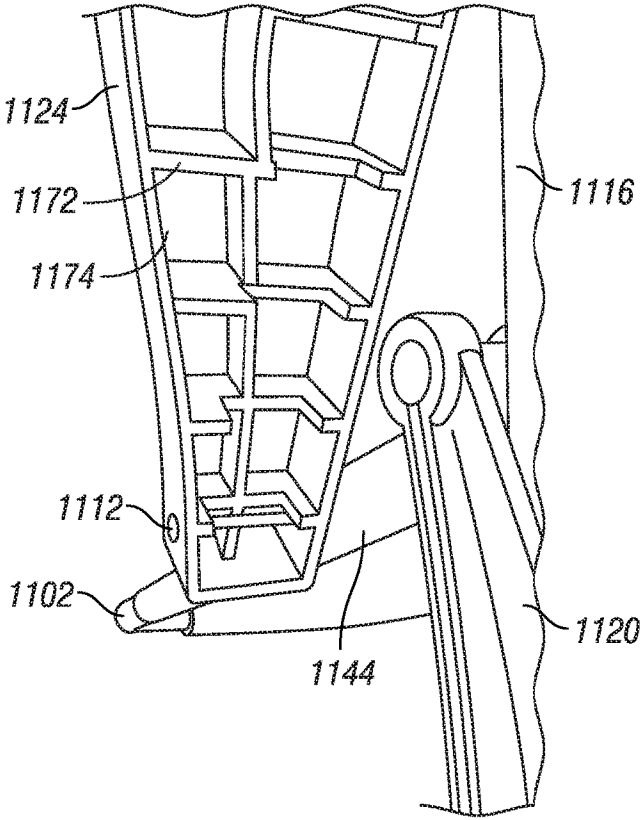

FIGS. 11A-11B depict an example embodiment of a second armrest 1124 underside. As shown in the example embodiments, various ribs 1172 can provide structural support for a hollow underside of Second armrest 1124 by extending from its undersurface 1174. As shown, Second armrest 1124 is in a seating configuration, with first side bar 1114 and second side bar 1116 in an angled configuration with respect to bracket 1118. Also shown are back support 1144 coupled to back bar 1102, armrest hinge 1112 and a portion of hinge 1120.

Figure 12A:
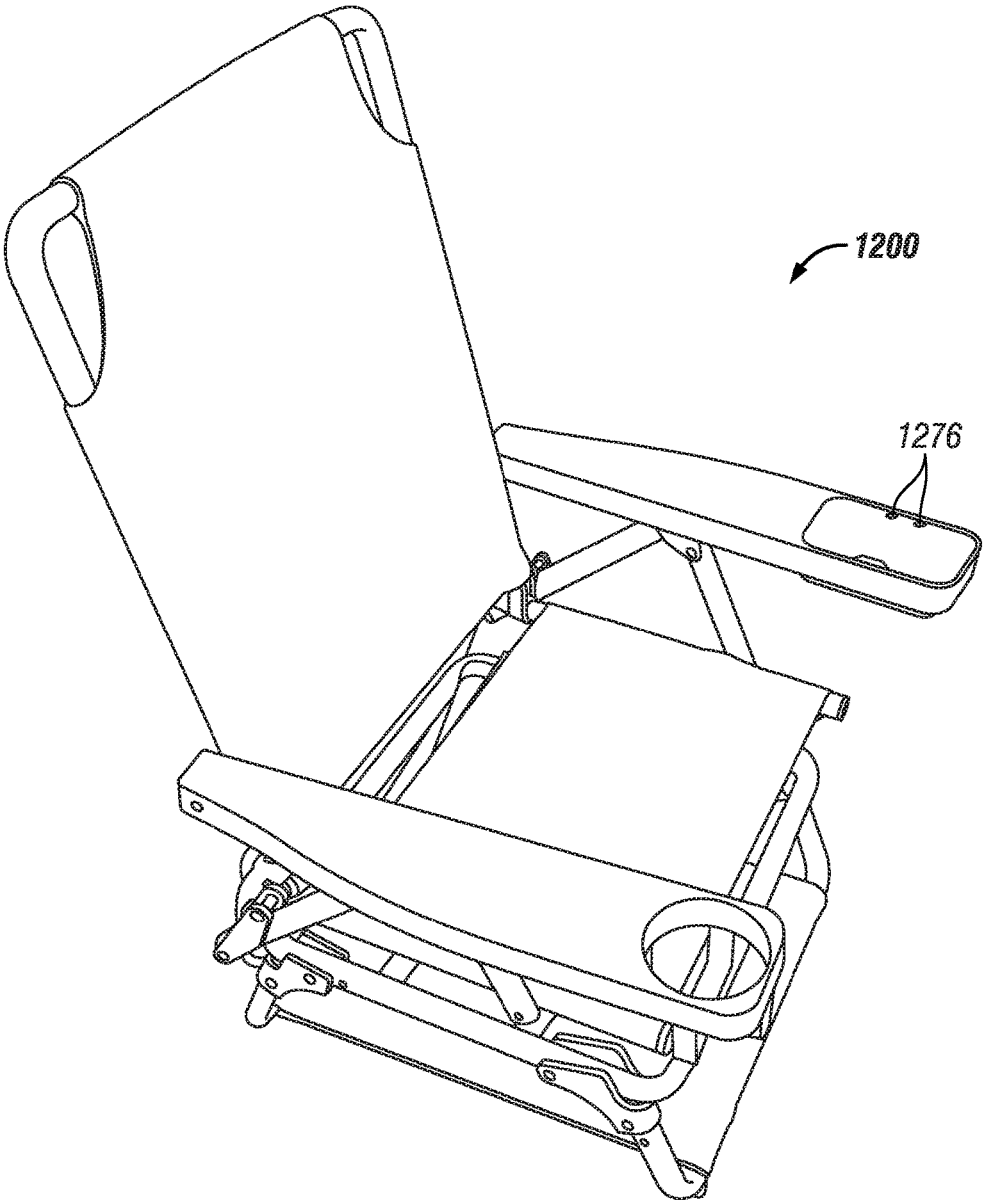
FIGS. 12A-12B depict an example embodiment of rotatable chair from a front left perspective and front top-down perspective view, respectively.
Figure 12B:
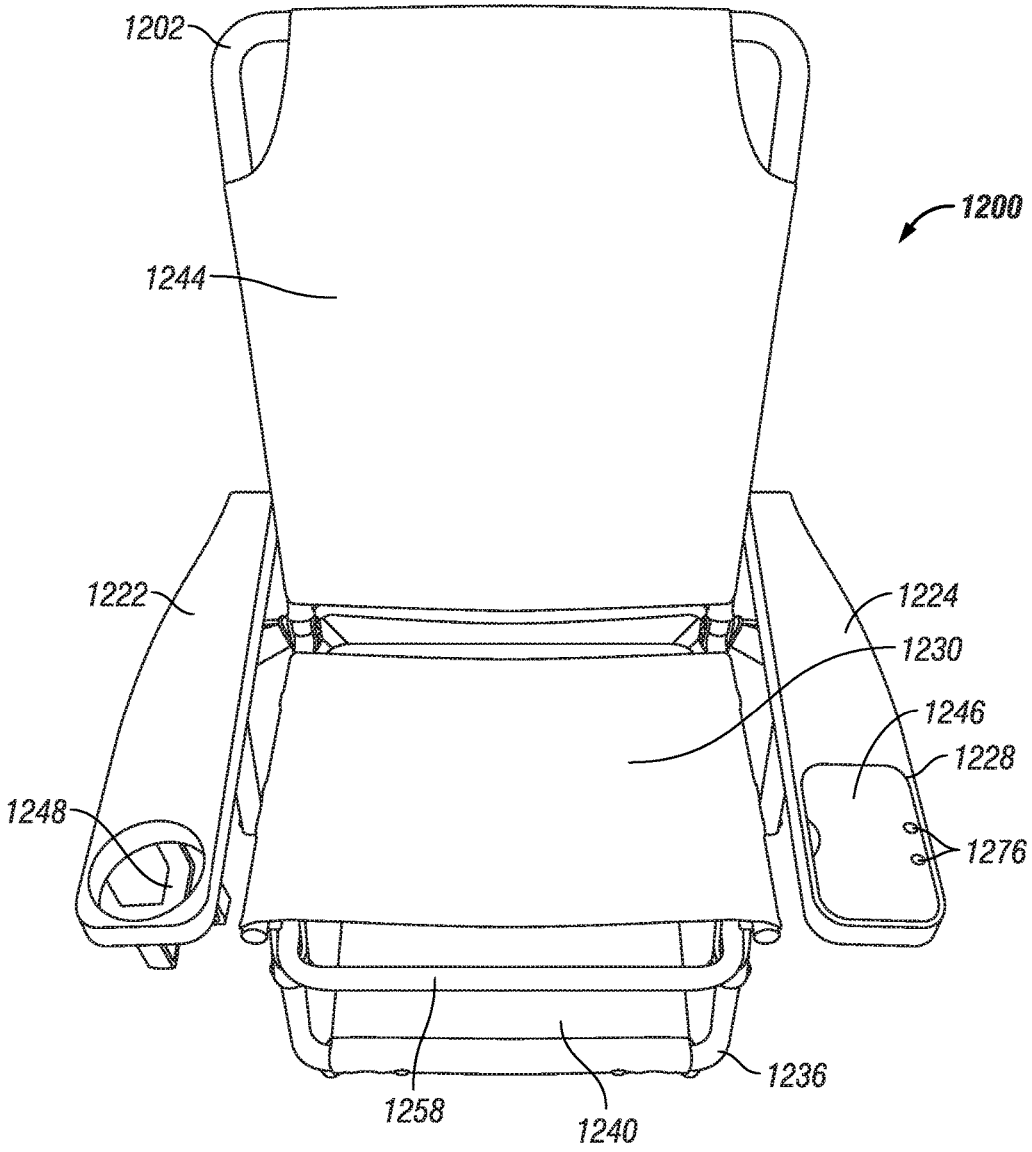

FIGS. 12A-12B depict an example embodiment of rotatable chair 1200 from a front left perspective and front top-down perspective view, respectively. FIG. 12B depicts back bar 1202, seat back support 1244, first arm rest 1222, second armrest 1224, beverage holder 1248, lower mounting structure 1258, and seat base 1230. As shown in the example embodiments of FIGS. 12A-12B, lid 1228 of compartment 1246 can include one or more small openings or holes 1276 to allow headphone wires to pass through, allowing one or more users to receive calls or listen to music using a smartphone, portable music player, wearable device or other electronic device without having the devices in their laps or hands.

In some embodiments, support base 1240 can include one or more bumper components made of rubber or other materials on its lower, ground-facing surface. This can provide improved stability and traction for rotating chair 1200 when it is placed on a solid surface, such as cement or concrete. As such, legs 1236 will be better held in place with respect to the ground and less likely to move or slip. This can be beneficial when rotating chair 1200 is being used on a sloped ground surface. Additionally, these bumper components can protect the material or materials of support base 1240 from directly contacting ground surfaces that could corrode, tear or otherwise degrade the integrity of the material or materials.

Figure 13:
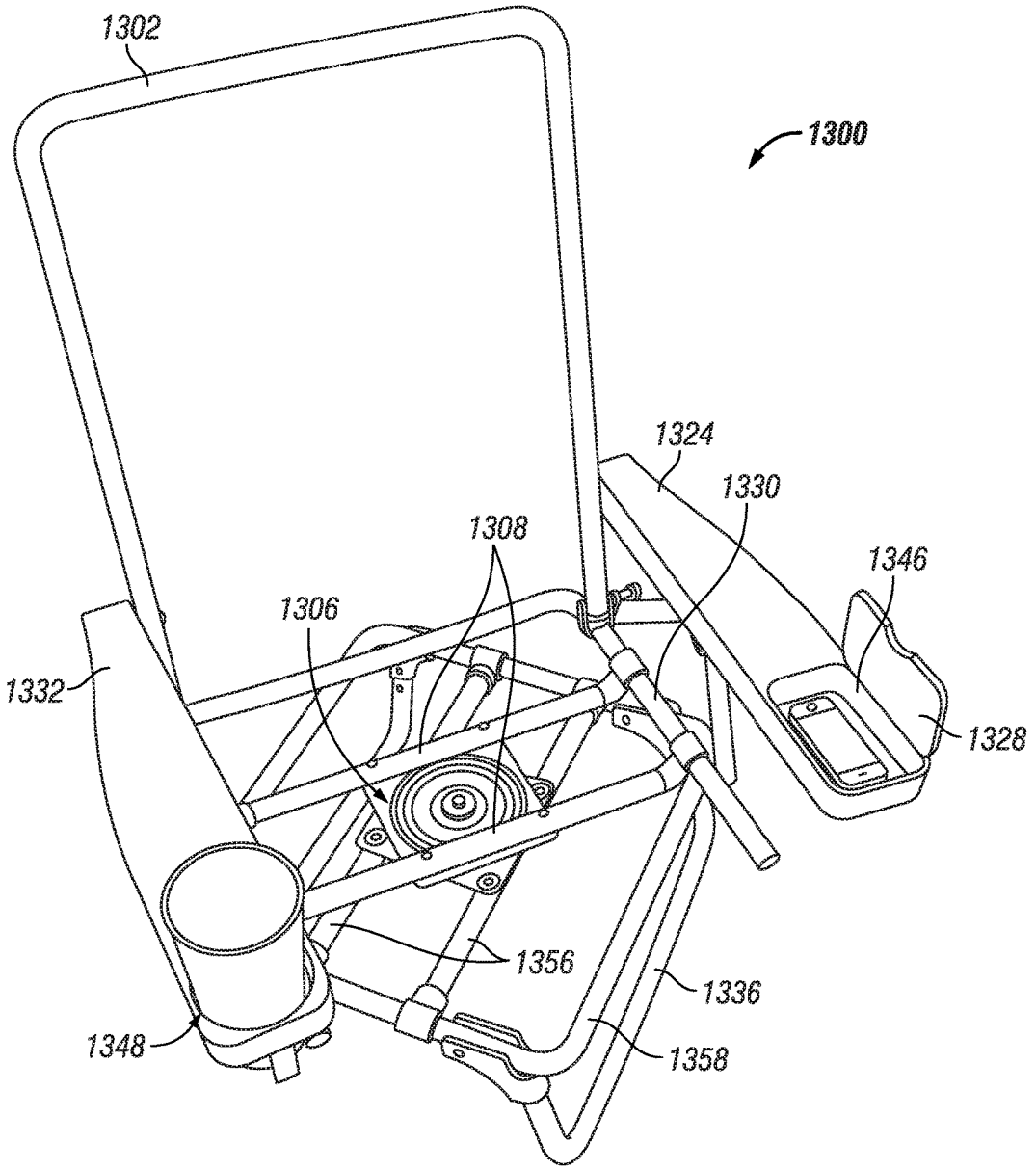
FIG. 13 depicts an example embodiment of rotatable chair frame from a front left perspective view.

FIG. 13 depicts an example embodiment of rotatable chair 1300 from a front left perspective view. Rotatable chair 1300 includes first are rest 1322, second arm rest 1324, back bar 1302, turntable 1306, under-seat 1308, seat base 1130, legs 1336, lower cross bars 1356 and lower mounting structure 1358. As shown in the example embodiment, chair 1300 can include compartment 1346 that is about two inches deep. In other embodiments, compartment 1346 can be deeper or shallower. Compartment 1346 is shown with lid 1328 in an open configuration, with a smartphone stored within. Beverage holder 1348 is shown as holding a large plastic cup.

Figure 14:
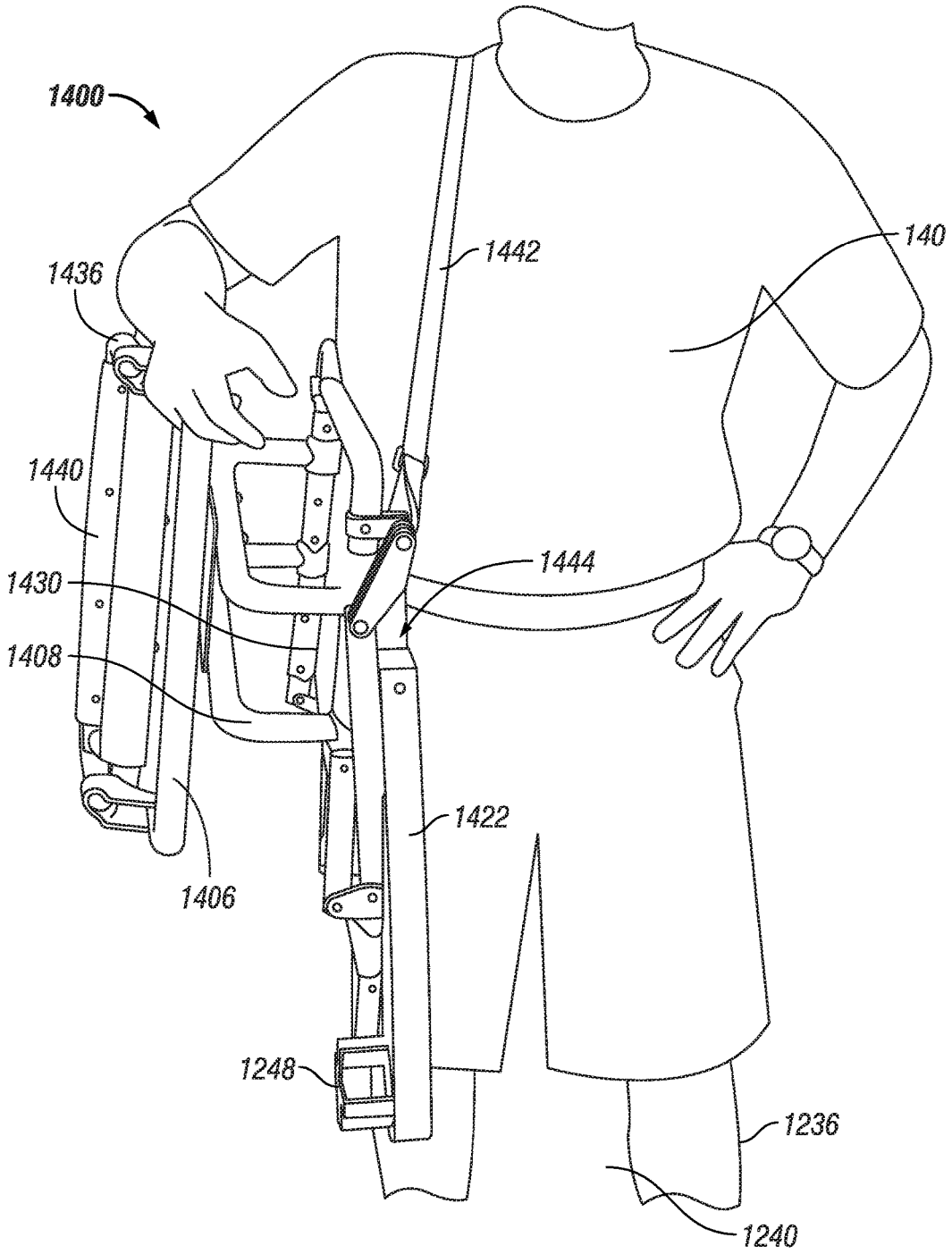
FIG. 14 depicts an example embodiment of rotatable chair frame in a folded configuration for carrying.

FIG. 14 depicts an example embodiment of rotatable chair 1400 in a folded configuration for carrying. FIG. 14, further depicts legs 1436, support base 1440, seat base 1430, under-seat base 1408, turntable 1406, back support 1444 and first arm rest 1422. User 140 is shown carrying the rotatable chair 1400. As shown in the example embodiment, in the folded configuration, chair 1400 can be about 8 or 8.5 inches wide. In some embodiments, turntables or other elements of chair 1400 can allow the rotating mechanisms to be locked, such that upper and lower chair sections improve user seating, carrying and transportation experience.

While it should be understood that different materials may vary in different embodiments of the invention, in some embodiments, Anodized Aluminum tubing can be used for bars, legs, brackets, cross-members and other support members, as well as for mounting plates and turntables. Similarly, High Density polyethylene can be used for various brackets, hinges, armrests, caps, compartment lids and others. Likewise, seat backing and seat bases can be UV Resistant Vinyl Coated Polyester Mesh materials, while carrying straps can be Nylon webbing.

Attachment or coupling of various components can be accomplished using hinges, screws, nuts, bolts, adhesives and various other elements and components, as known in the art or later developed.

In some embodiments, chairs as described herein can have sturdiness enhanced or decreased by replacing one or more plastic components with metal, or metal with plastic. For example, in some embodiments, plastic connectors at the seat base can be replaced them with metal cross members. These changes can help to provide additional strength to chairs or provide cost and weight improvements.

In various embodiments, due to the requirements of various different users and manufacturers hinges, brackets, bars, plates and other elements described herein can be constructed in thicker or thinner configurations to reinforce, reduce weight, improve performance and provide other benefits.

In some embodiments, other features not shown in the figures can be included. These can include pockets coupled with or otherwise attached to one or more of back supports, seat bases, armrests and others. In some embodiments pockets can be integrated and flush with shown elements while in other embodiments they can hang from different elements. These additional features can improve user experience by adding additional functionality, improving convenience or other benefits.

As used herein and in the appended claims, the singular forms "a", "an", and "the" include plural referents unless the context clearly dictates otherwise.

The publications discussed herein are provided solely for their disclosure prior to the filing date of the present application. Nothing herein is to be construed as an admission that the present disclosure is not entitled to antedate such publication by virtue of prior disclosure. Further, the dates of publication provided may be different from the actual publication dates which may need to be independently confirmed.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

What is claimed is:

1. A rotating chair apparatus, comprising:
an upper chair section;
a lower chair section, comprising:
a plurality of legs: and
a support base removabley attached to a lower end of each of the plurality of legs,
the support base comprises a single layer of pliable material;
wherein the support base forms a planar surface that extends between opposing legs when the rotating chair is in use; and
a turntable having an upper plate coupled to upper chair section and a lower plate coupled to lower chair section,
wherein the upper plate and lower plate are rotatably coupled such that their coupling allows the upper chair section to rotate with respect to the lower chair section.

2. The rotating chair apparatus of claim 1, wherein the upper chair section further comprises:
a first arm and a second arm;
a seating base; and
a seat backing.

3. The rotating chair apparatus of claim 2, wherein the upper chair section further comprises:
a plurality of carrying straps operable to allow a user to carry the chair as a backpack.

4. The rotating chair apparatus of claim 2, wherein the first arm further comprises:
a beverage holder.

5. The rotating chair apparatus of claim 2, wherein the second arm further comprises:
a compartment having a hollow interior for holding items.

6. The rotating chair apparatus of claim 5, wherein the second arm further comprises:
a closable lid for sealing the compartment.

7. The rotating chair apparatus of claim 1, wherein the support base further comprises:
pliable material selected from the group consisting of Cordura, vinyl coated polyester mesh, UV-coated vinyl coated polyester mesh, canvas, rubberized material and nylon fabric.

8. The rotating chair apparatus of claim 1, further comprising:
at least one pocket.

9. The rotating chair apparatus of claim 1, further comprising:
at least one bumper component, operable to directly contact a ground surface and prevent at least one of the plurality of legs or at least a portion of the support base from directly contacting the ground surface.

10. The rotating chair apparatus of claim 1, wherein the turntable further comprises:
at least one ball bearing.

11. A rotating chair system, comprising:
an upper chair area including upper chair components;
a lower chair area including lower chair components, comprising:
a plurality of legs; and
a support base coupled around a lower end of each of the plurality of legs,
the support base comprises a single layer of pliable material;
wherein the support base forms a planar surface that extends between opposing legs when the rotating chair is in use; and
a turntable including:
an upper plate coupled to at least one of the upper chair components;
a lower plate coupled to at least one of the lower chair components; and
a central bolt coupled to the center of the upper plate and the lower plate;
wherein the upper chair area is rotatable with respect to the lower chair area based on rotation of the turntable about the central bolt.

12. The rotating chair system of claim 11, wherein the upper chair components further comprise:
a first arm and a second arm;
a seating base; and
a seat backing.

13. The rotating chair system of claim 12, wherein the first arm further comprises:
a beverage holder.

14. The rotating chair system of claim 12, wherein the second arm further comprises:
a compartment having a hollow interior for holding items.

15. The rotating chair system of claim 14, wherein the second arm further comprises:
a closable lid for sealing the compartment.

16. The rotating chair system of claim 12, wherein the upper section further comprises:
a reclining mechanism operable to allow a user change an angle of orientation of the seat backing with respect to an orientation of the seating base.

17. The rotating chair system of claim 11, wherein the support base further comprises:
pliable material selected from the group consisting of Cordura, vinyl coated polyester mesh, UV-coated vinyl coated polyester mesh, canvas, rubberized material and nylon fabric.

18. The rotating chair system of claim 11, wherein the plurality of legs are operable to be folded with respect to the support base, to provide for compact carrying by a user.

19. A method of manufacturing a rotating chair, having an upper chair section that rotates with respect to a lower chair section comprising:
coupling a turntable upper plate to the upper chair section;
coupling a turntable lower plate to the lower chair section; and
coupling a support base around a lower end of each of a plurality of legs of the chair,
wherein the support base, which is comprised of single layer of a pliable material, forms a planar surface that extends between opposing legs when the rotating chair is in use, and
wherein the turntable includes a central bolt allowing one or both of the turntable upper plate and the turntable lower plate to rotate with respect each other about a central axis of the central bolt.

* * * * *